United States Patent [19]

Yokonuma

[11] Patent Number: 4,751,436

[45] Date of Patent: Jun. 14, 1988

[54] DEVICE FOR BOOSTING POWER SUPPLY VOLTAGE

[75] Inventor: Norikazu Yokonuma, Tokyo, Japan

[73] Assignee: Nippon Kogaku K. K., Tokyo, Japan

[21] Appl. No.: 713,839

[22] Filed: Mar. 20, 1985

[30] Foreign Application Priority Data

Mar. 26, 1984 [JP] Japan ..... 59-57577

[51] Int. Cl.[4] ..... H05B 41/14

[52] U.S. Cl. ..... 315/241 P; 315/239

[58] Field of Search ..... 315/241 P, 241 S; 354/145 L, 135

[56] References Cited

U.S. PATENT DOCUMENTS 3,947,720 3/1976 Breitkreuz ..... 315/241 P
4,131,843 12/1978 Koyama et al. ..... 361/18
4,236,796 12/1980 Hayashi et al. ..... 354/145.1

OTHER PUBLICATIONS

*Research Disclosure*, No. 188, Dec. 1979, p. 691, Abstract No. 18849, Schauffele, C. N., "A Firing Circuit for an Electronic Strobe Flash Unit".

*Primary Examiner*—David K. Moore
*Assistant Examiner*—Theodore C. Salindong
*Attorney, Agent, or Firm*—Shapiro and Shapiro

[57] ABSTRACT

A device for boosting power supply voltage is provided with a transformer having a secondary winding which generates an elevated voltage when the power supply current is supplied to the primary winding, whereby the voltage generated in the secondary winding is supplied to a load while voltages corresponding to the inverse electromotive force generated in the primary winding are supplied to another load.

14 Claims, 1 Drawing Sheet

DEVICE FOR BOOSTING POWER SUPPLY VOLTAGE

BACKGROUND OF THE INVENTION

1. Field of the Invention

The present invention relates to a device for boosting power supply voltage.

2. Description of the Prior Art

The number of batteries usable as a power source is becoming limited due to recent miniaturization of electronic apparatus. In such apparatus a voltage elevating circuit is employed for compensating a low power supply voltage.

However, when plural elevated voltages are obtained from a single blocking oscillator of the voltage elevating device, there should be employed, for example, a transformer with plural secondary windings, which is inevitably expensive due to complicated structure thereof.

SUMMARY OF THE INVENTION

An object of the present invention is to provide an inexpensive voltage boosting device which can supply enough voltages to plural loads without complicating the structure of the transformer in the voltage boosting circuit.

The above-mentioned object is achievable according to the present invention by a device provided with a transformer having a secondary winding which generates an elevated voltage when the power supply circuit is supplied to the primary winding, whereby the voltage generated in said secondary winding is supplied to a load while voltage corresponding to the inverse electromotive force generated in the primary winding is supplied to another load.

DETAILED DESCRIPTION OF THE PREFERRED EMBODIMENTS

Figure 1:
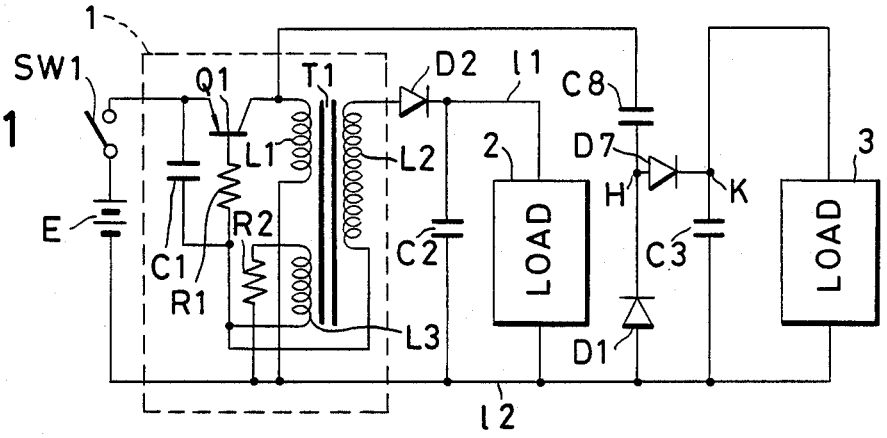
FIG. 1 is a circuit diagram of an embodiment of the present invention.

Referring to FIG. 1, an electric power source E is connected to a voltage boosting circuit 1, and a power supply voltage elevated by said voltage boosting circuit 1 is supplied to a power supply line l1. Between said power supply line l1 and a ground line l2 there are connected a capacitor C2 and a load 2. The voltage boosting circuit 1 is composed of a transistor Q1, a capacitor C1, resistors R1, R2 and a transformer T1. The positive pole of the power source E is connected to the emitter of the transistor Q1, the collector of which is connected to the ground line l2 through a primary winding L1 of the transformer T1, and the base of which is connected to the power supply line l1 through the resistor R1, a secondary winding L2 and a diode D2, and also to the ground line l2 through the resistor R1, a winding L3 and the resistor R2. Between the emitter and the base of the transistor Q1 there is connected the capacitor C1. The junction between the collector of the transistor Q1 and the primary winding L1 of the transformer T1 is connected to the ground line l2 through a capacitor C8 and a diode D1 which are serially connected. To the diode D1 there is connected, in parallel, a series circuit composed of a diode D7 and a capacitor C3, which is further connected in parallel to a load 3.

Figure 2:
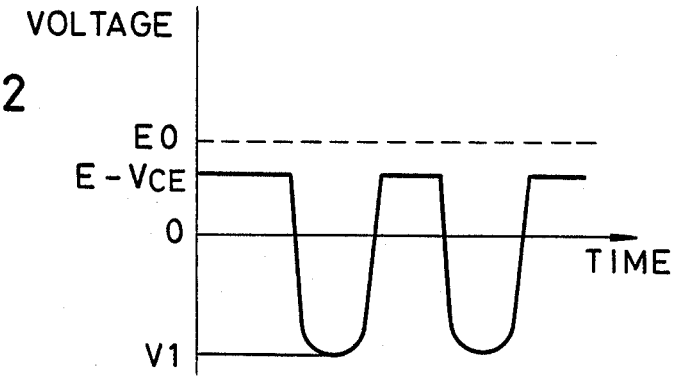
FIG. 2 is a wave form chart showing the inverse electromotive force generated in the primary winding of the transformer shown in the circuit in FIG. 1.

In the following there will be given an explanation of the function of the embodiment, wherein the conductive and non-conductive states of the transistor Q1 are represented by "on" and "off". When a power switch SW1 is closed, the power source voltage E is supplied to the emitter of the transistor Q1 and a current is supplied through the capacitor C1, winding L3 of the transformer T1 and resistor R2 to instantaneously charge the capacitor C1. Thus a base current is generated in the base of the transistor Q1 through the resistor R1, winding L3 and resistor R2 thereby turning on the transistor Q1. In response a current is generated in the primary winding L1 of the transformer T1 to generate voltage in the secondary winding L2 and winding L3. In this state the voltage generated in the winding L3 applies a positive feedback to the transistor Q1, thus amplifying the collector current of the transistor Q1 to the voltage elevating limit of the transformer T1. Upon reaching said limit, the collector current is no longer amplified but is attenuated whereby the base current is attenuated to turn off the transistor Q1. The above-described operation is repeated to cause oscillation, and the elevated voltage generated at the secondary side of the transformer T1 is supplied, after rectification and smoothing by the diode D2 and capacitor C2, to the load 2. At the same time the turning off of the transistor Q1 generates an inverse electromotive force in the primary side of the transformer T1, whereby the potential of the collector of the transistor Q1 is shifted, as shown in FIG. 2, from a voltage $E-V_{CE}$ which is the difference between the power source voltage E and the emitter-collector voltage $V_{CE}$ of the transistor Q1, to a negative voltage V1, which is charged into the capacitor C8 through the diode D1. In this manner, the capacitor C8 is charged by the inverse electromotive force generated in the primary winding L1 when the transistor Q1 is turned off. At the next instant, the transistor Q1 is turned on, whereby there is generated, at the junction H between the capacitor C8 and the diode D1, a voltage which is equal to the sum of the absolute value of the charged voltage V1 of the capacitor C8 and the collector voltage $E_0-V_{CE}$ of the transistor Q1, in which $E_0$ is the voltage of the power source E. The voltage $|V1|+E_0-V_{CE}$ at the junction H is rectified and smoothed by the diode D7 and the capacitor C3, so that a rectified and smoothed voltage $V2=|V1|+E_0-V_{CE}$ is generated at the junction K between the diode D7 and the capacitor C3. The load 3 is driven by said voltage V2. The inverse electromotive force generated in the primary winding of the transformer T1 can be made several times higher than the power source voltage E by the number of turns of the winding.

Figure 3:
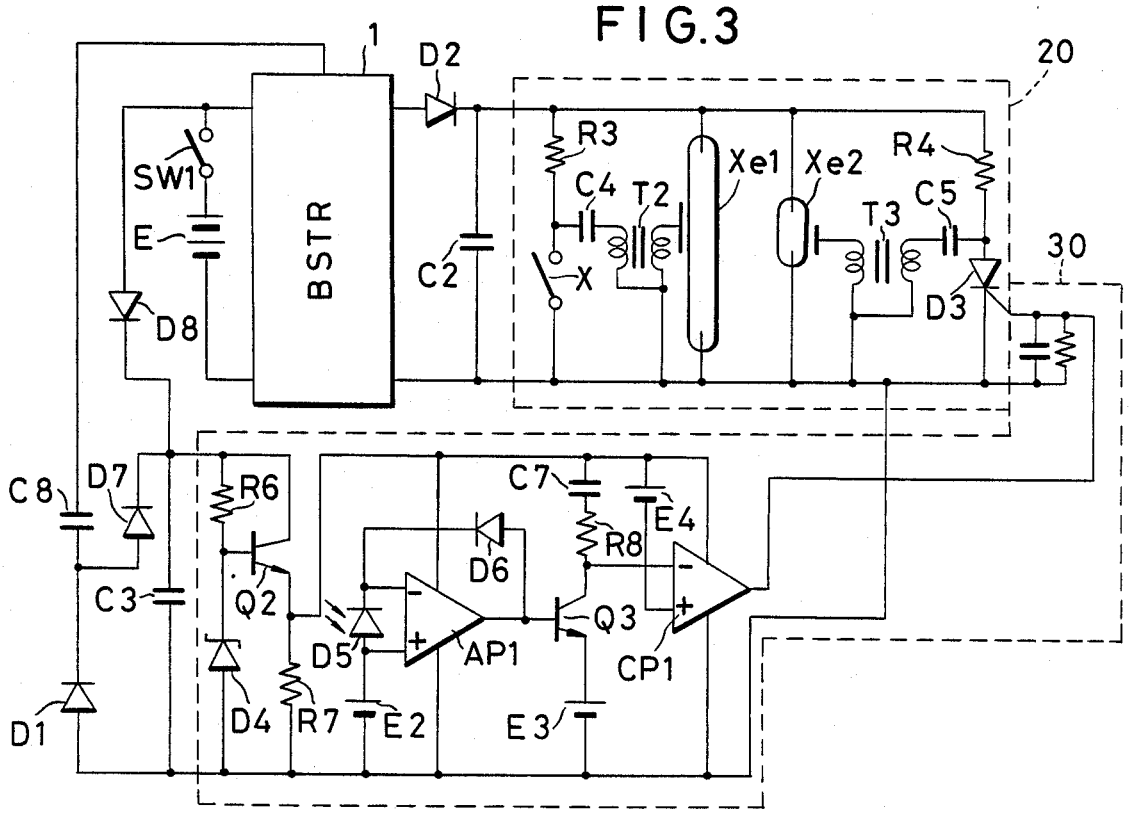
FIG. 3 is a circuit diagram in which the device of the present invention is applied to a flash device of a camera.

FIG. 3 shows an embodiment in which the device of the present invention is applied to an electronic flash device of a camera. In this embodiment the load 2 of FIG. 1 corresponds to a trigger circuit of the flash device, and the load 3 corresponds to a light control circuit of the flash device. The conventional electronic flash device generally uses four UM-3 batteries, the voltage boosting device of the present invention allows reduction of the number of batteries to two, thus enabling miniaturization of the flash device.

In the circuit shown in FIG. 3, a capacitor C2 is charged by an elevated voltage generated by a voltage boosting or elevating circuit 1 connected to a 3 V power source E consisting of two UM-3 batteries. The elevated voltage also charges a trigger capacitor C4 of a transformer T2 through a resistor R3, and a trigger capacitor C5 of a transformer T3 through a resistor R4.

A xenon discharge lamp Xel in a trigger circuit 20 is used for illuminating the object, while a quench tube Xe2, containing an inert gas such as xenon, has a lower impedance than that of the xenon discharge lamp Xe1 for terminating the flash discharge therein and is connected parallel thereto. The quench tube Xe2 is placed in such a position that the flash thereof does not leak to the outside.

A light regulating circuit 30 receives a voltage from the capacitor C3 which is charged by the inverse electromotive force generated in the primary winding L1 of the voltage elevating circuit 1. The light regulating circuit 30 is also connected to the power source E through a diode D8, whereby the voltage supplied to said light regulating circuit 30 does not become lower than $E_0$. The light regulating circuit 30 receives the charged voltage of the capacitor C3 as an elevated voltage which is higher than the power source voltage E and is stabilized by a voltage stabilizing circuit composed of resistors R6, R7, a Zener diode D4 and a transistor Q2. When a synchronizing contact X in the trigger circuit 20 is closed, the capacitor C4 is discharged through the primary side of the trigger transformer T2, thereby generating a high voltage in the secondary side thereof and causing a flash discharge in the xenon discharge lamp Xel.

The light reflected by an object illuminated by the flash from the xenon discharge lamp Xe1 is photoelectrically converted by a photosensor D5 in the light regulating circuit 30, and the resulting photocurrent is amplified, in an amplifying circuit composed of an operational amplifier AP1, a diode D6, a transistor Q3 and reference voltage sources E2, E3 with an amplification factor determined by the difference between said reference voltages E3 and E2. The photocurrent thus amplified charges an integrating capacitor C7 of an integrating circuit composed of said integrating capacitor C7 and a differentiating correction resistor R8.

When the integrating capacitor C7 is charged to a reference voltage E4, i.e. when the amount of flash reaches an adequate value, the output of a comparator CP1 changes from a low level to a high level to turn on a thyristor D3, whereby the trigger capacitor C5 is discharged to generate a high voltage at the secondary side of the transformer T3, thus causing a flash discharge in the quench discharge lamp Xe2 and terminating the flash discharge in the xenon discharge lamp Xe1. In general, the voltage to be supplied to the trigger circuit 20 is in the order of several hundreds of volts while the voltage to be supplied to the light regulating circuit can be in the order of 3 volts. Consequently, a voltage corresponding to the inverse electromotive force generated in the primary winding L1 of the transformer is enough for supply to the light regulating circuit 30.

In this manner, the present embodiment can achieve satisfactory performance even with a power source of a smaller capacity than in the conventional flash device, through the effective use of the inverse electromotive force generated in the primary winding of the transformer T1 in the voltage boosting circuit 1. Besides, the flash device of the present embodiment can be easily constructed compact because of the use of a smaller power source, and is featured by a simple structure, as the power source of a lower power is compensated simply by the use of the primary winding L1 of the transformer T1 of the voltage boosting circuit 1.

What is claimed is:

1. An electronic flash device for a camera provided with primary winding means, means for supplying current to said primary winding means, secondary winding means adapted to generate a voltage in accordance with current supplied to said primary winding means, and flash means for generating flash light toward an object in response to the voltage generated in said secondary winding means, comprising:

(a) means for generating an inverse electromotive force having a magnitude in said primary winding means, said generating means including switching means provided with a terminal for interrupting current supplied to said primary winding means;

(b) integrating means for integrating light from said object illuminated by said flash means and controlling said flash means;

(c) charge storing means electrically connected to said primary winding means to store a charge proportional to the magnitude of said inverse electromotive force generated in said primary winding means when said switching means interrupts current supplied to said primary winding means, said terminal of said switching means being electrically connected to a connection point between said charge storing means and said primary winding means; and (d) means for applying a voltage to said integrating means in accordance with said charge stored in said charge storing means.

2. An electronic flash device according to claim 1, wherein said charge storing means includes capacitor means provided with two terminals, one of said two terminals of said capacitor means being electrically connected to said primary winding means.

3. An electronic flash device according to claim 2, wherein said charge storing means includes unidirectional means having two terminals, said unidirectional means enabling current to flow in one direction only between said two terminals thereof.

4. An electronic flash device according to claim 3, wherein the other of said two terminals of said capacitor means is connected to one of said two terminals of said unidirectional means.

5. An electronic flash device according to claim 4, wherein said unidirectional means is connected to enable current to flow from the other of said two terminals thereof to said one of said two terminals thereof.

6. An electronic flash device according to claim 5, wherein the other of said two terminals of said unidirectional means is connected to a ground line.

7. An electronic flash device according to claim 5, which further comprises a power supply line to which a desired potential is supplied, wherein a potential of said other of said two terminals of said unidirectional means is lower than said desired potential.

8. An electronic flash device for a camera comprising:

(a) blocking oscillator means provided with primary winding means, means for supplying current to said primary winding means, secondary winding means and switching means provided with a terminal for interrupting current supplied to said primary winding means and thereby generating an inverse electromotive force having a magnitude in said primary winding means, said secondary winding means being adapted to generate a voltage in accordance with current supplied to said primary winding means;

(b) flash means for generating flash light toward an object in response to the voltage generated in said secondary winding means;

(c) integrating means for integrating light from said object illuminated by said flash means and controlling said flash means;

(d) charge storing means electrically connected to said primary winding means to store a charge proportional to the magnitude of said inverse electromotive force generated in said primary winding means when said switching means interrupts current supplied to said primary winding means, said terminal of said switching means being electrically connected to a connection point between said charge storing means and said primary winding means; and (e) means for applying a voltage to said integrating means in accordance with said charge stored in said charge storing means.

9. An electronic flash device according to claim 8, wherein said charge storing means includes capacitor means provided with two terminals, one of said two terminals of said capacitor means being electrically connected to said primary winding means.

10. An electronic flash device according to claim 9, wherein said charge storing means includes unidirectional means having two terminals, said unidirectional means enabling current to flow in one direction only between said two terminals thereof.

11. An electronic flash device according to claim 10, wherein the other of said two terminals of said capacitor means is connected to one of said two terminals of said unidirectional means.

12. An electronic flash device according to claim 11, wherein said unidirectional means is connected to enable current to flow from the other of said two terminals thereof to said one of said two terminals thereof.

13. An electronic flash device according to claim 12, wherein the other of said two terminals of said unidirectional means is connected to a ground line.

14. An electronic flash device according to claim 12, which further comprises a power supply line to which a desired potential is supplied, wherein a potential of said other of said two terminals of said unidirectional means is lower than said desired potential.

* * * * *